United States Patent [19]

Barradas

[11] 3,981,314

[45] Sept. 21, 1976

[54] HAIR DRYER

[75] Inventor: George Barradas, Glenville, Conn.

[73] Assignee: Venus Electric Limited, Scarborough, Canada

[22] Filed: Sept. 25, 1975

[21] Appl. No.: 616,550

[52] U.S. Cl. ..... 132/9; 34/97

[51] Int. Cl.[2] ..... A45D 20/00

[58] Field of Search ..... 132/9, 11 A, 11 R; 36/97, 98, 91; 15/415, 396, 345, 400; 222/144.5

[56] References Cited

UNITED STATES PATENTS

| | | | |
|---|---|---|---|
| 2,713,627 | 7/1955 | Kamataris | 34/97 UX |
| 3,835,869 | 9/1974 | Newman | 132/11 |
| 3,854,489 | 12/1974 | Doyle et al. | |
| 3,857,016 | 12/1974 | Meyer | 34/97 |
| 3,868,495 | 2/1975 | Dyer | 34/97 |

*Primary Examiner*—G.E. McNeill

*Attorney, Agent, or Firm*—Bacon & Thomas

[57] ABSTRACT

A hair dryer comprises an elongated casing which provides a fan housing and a heater housing extending longitudinally therefrom. The fan housing has a pair of laterally spaced air inlets and the heater housing provides an air outlet. The fan motor is mounted in the fan housing, and drives a pair of fans which cooperate respectively with the air inlets. A deflector is located in the fan housing and positioned to deflect incoming air from each of the inlets into the heater housing. In one embodiment the heater housing is in the form of a tubular nozzle to which interchangeable attachments may be fitted. In another embodiment, the heater housing is closed at its end and has an elongated opening in its wall.

11 Claims, 8 Drawing Figures

Fig. 7.
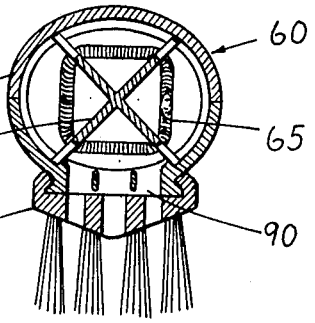
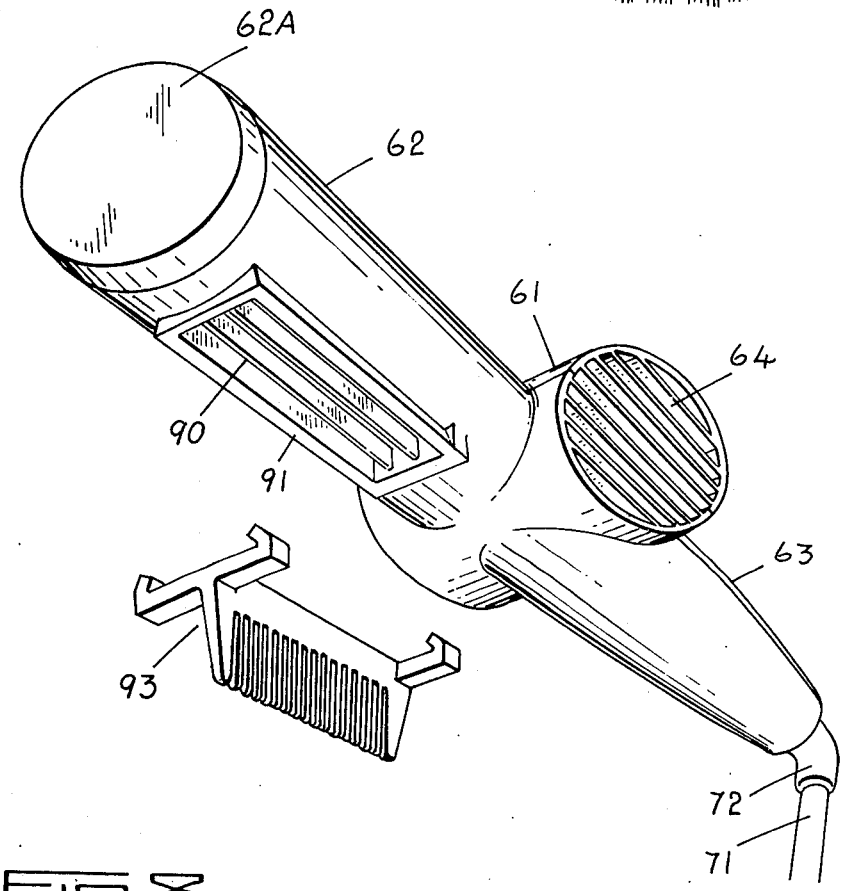
Fig. 8.

HAIR DRYER

FIELD OF THE INVENTION

This invention relates to hair dryers, and is concerned more particularly with hair dryers which are intended to be held in the hand of the user.

BACKGROUND OF THE INVENTION

The fan size of a conventional hair dryer sets a limit on its power rating, since any increase in the power supplied to the hair dryer which is not accompanied by a corresponding increase in the rate of air flow will necessarily raise the air temperature. Excessive air temperatures would be uncomfortable to the user and even dangerous. In order to construct a hair dryer which is capable of providing a higher rate of heat output than a conventional hair dryer, it is necessary to find some way of increasing the air flow. In the case of a hand-held hair dryer, this presents a problem since too large a fan is liable to make the hair dryer cumbersome and unusable.

In one hair dryer which is currently being sold, this problem has been met by providing a pair of fans each cooperating with a respective air inlet in the casing of the dryer, the fans being mounted one at each end of a common drive shaft which extends through the heating section of the dryer and is driven by a motor at one end of the casing. While this arrangement permits a higher rate of air flow than was previously possible, a disadvantage results from the fact that the fans are located at opposite ends of the heater section and act in direct opposition to one another.

An object of the present invention is to provide an alternative arrangement which permits a higher rate of air flow while avoiding this disadvantage.

SUMMARY OF THE INVENTION

According to the invention, the casing of the hair dryer provides a fan housing and a heater housing extending therefrom, the fans and the heater section being housed in the respective housings, and the fan housing including a deflector for deflecting incoming air into the heater housing. More specifically, a hair dryer in accordance with the invention comprises an elongated casing providing a fan housing and a heater housing extending longitudinally therefrom, the fan housing providing a pair of laterally spaced air inlets and the heater housing providing an air outlet, electric heating means mounted in the heater housing, an electric motor mounted in the fan housing, a pair of fans located in the fan housing and coupled to the motor to be driven thereby, each fan cooperating with a respective one of the air inlets, deflector means located in the fan housing and positioned to deflect incoming air from each of the inlets into the heater housing, and means for supplying electric current to the electric heating means and the motor.

BRIEF DESCRIPTION OF THE DRAWINGS

In order that the invention may be readily understood, two embodiments thereof will now be described by way of example. In the drawings:

FIG. 7 is a cross section on line 7 — 7 in FIG. 6; and

FIG. 8 is a perspective view of the hair dryer shown in association with a different attachment.

DESCRIPTION OF THE PREFERRED EMBODIMENTS

Figure 1:
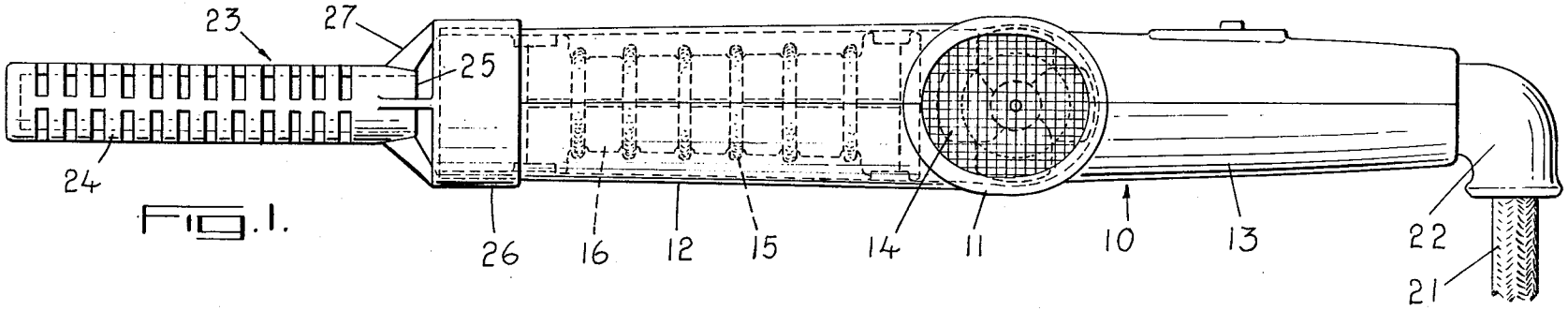
FIG. 1 is a side elevational view of a hair dryer according to one embodiment of the invention, the hair dryer being fitted with a hair dressing attachment.

The hair dryer shown in FIGS. 1 – 4 has a casing 10 formed of two complementary half shells of molded plastic material, the casing being split in a medial longitudinal plane. The casing 10 provides a fan housing 11, a heater housing 12, extending longitudinally from the fan housing, the heater housing 12 defining a longitudinal axis, and a tubular elongated handle portion 13 which extends longitudinally from the fan housing substantially in alignment with the housing 12. The fan housing 11 is of generally cylindrical shape having an axis which is transverse to the longitudinal axis of the heater housing. The ends of the fan housing 11 provide a pair of laterally spaced, circular, air inlets 14. The heater housing 12 is in the form of a tubular nozzle having a short axially extending, cylindrical terminal portion 12A (FIG. 3), this terminal portion defining an air outlet. The tubular nozzle is tapered from the fan housing to the terminal portion 12A.

An electric resistance heating element 15 mounted on a former 16 is located in the heater housing 12. In the illustrated embodiment the heating element is made up of a number of coiled sections connected electriclly in series, the sections being spaced longitudinally along the housing 12. An electric fan motor 17 is mounted in the fan housing 11 coaxially therewith, the motor having a pair of opposed drive shafts 18 extending transversely with respect to the heater housing 12. A pair of fans 19, mounted respectively on the drive shafts 18 so as to be driven thereby, are positioned adjacent to the air inlets 14, each fan cooperating with the respective air inlet so as to cause an intake of air therethrough when the fan is driven.

Also located in the fan housing 11 is a deflector 20. The deflector is V-shaped in plan so as to provide a pair of wall surfaces which are positioned to intercept incoming air from the air inlets 14, and are inclined so as to deflect the air axially into the heater housing 11, and through the heater section to the air outlet in the terminal portion 12A. The deflector 20 is formed of two complementary sections which meet in the medial longitudinal plane of the casing 10, just one of the sections being shown in FIG. 3. Each section of the deflector is of molded plastic material and is integral with a respective one of the molded, complementary half shells of the casing. Electric conductors for supplying current to the heating element 15 and the motor 17 extend through the handle portion 13 and are brought out via a cable 21 via a socket 22 which provides a swivel at the end of the hand portion 13.

Figure 2:
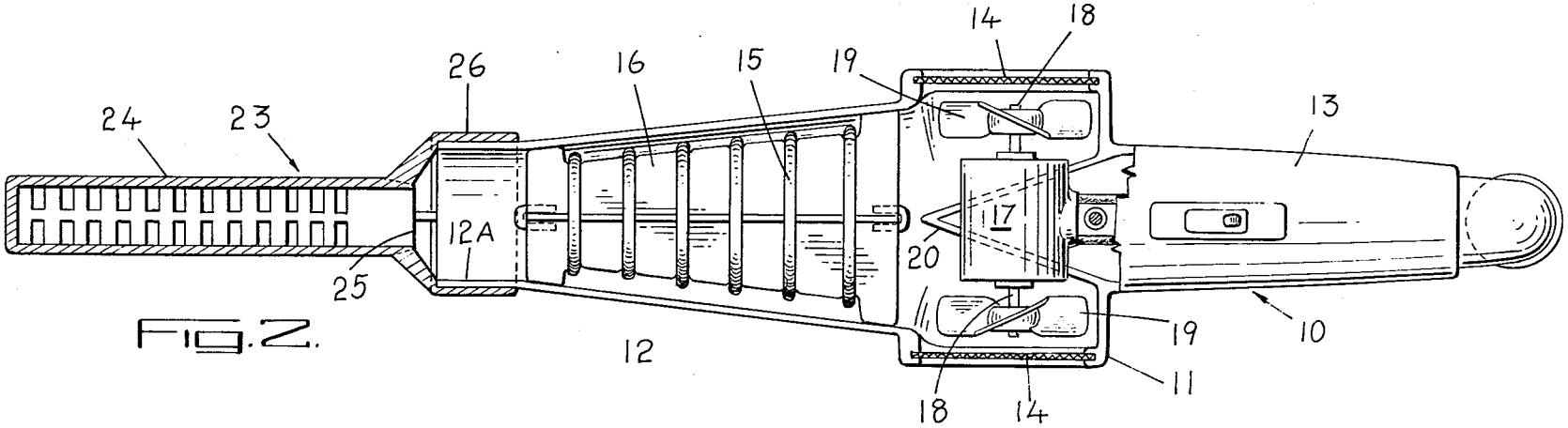
FIG. 2 is a top plan view, partly in section, of the hair dryer.

The hair dryer is adapted to be used with a plurality of interchangeable hair dressing attachments, which can be connected to the terminal portion 12A of the nozzle. The attachment shown in FIGS. 1 and 2 is a hair roller 23. The hair roller comprises an elongated, perforate, hollow body 24 having an air inlet opening 25 at one end. The inlet end of the roller is provided with a socket in the form of a cylindrical ring 26, which is connected to the end of the body 24 by radial webs 27. The ring 26 simply fits over the cylindrical terminal portion 12A of the nozzle to connect the hair roller to the hair dryer. In operation, drying air is blown into the interior of the hair roller through the air inlet 25, and is also blown externally of the roller through openings between the webs 27.

Figures 3, 4:
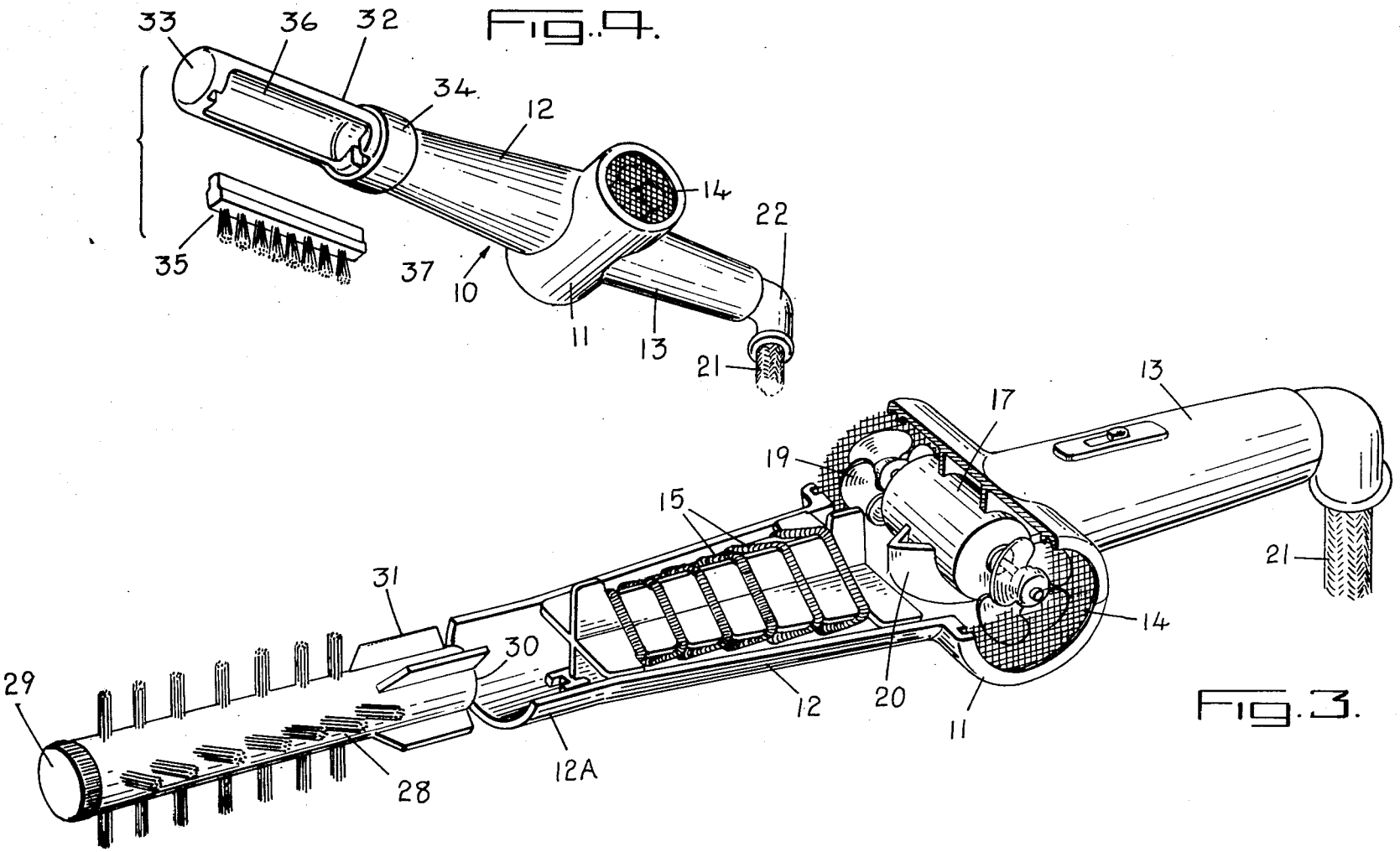
FIG. 3 is a perspective view of the hair dryer, but with part of the casing removed to show internal structure, and a second hair dressing attachment being shown.
FIG. 4 is a perspective view of the hair dryer, fitted with yet another attachment.
Figure 5:
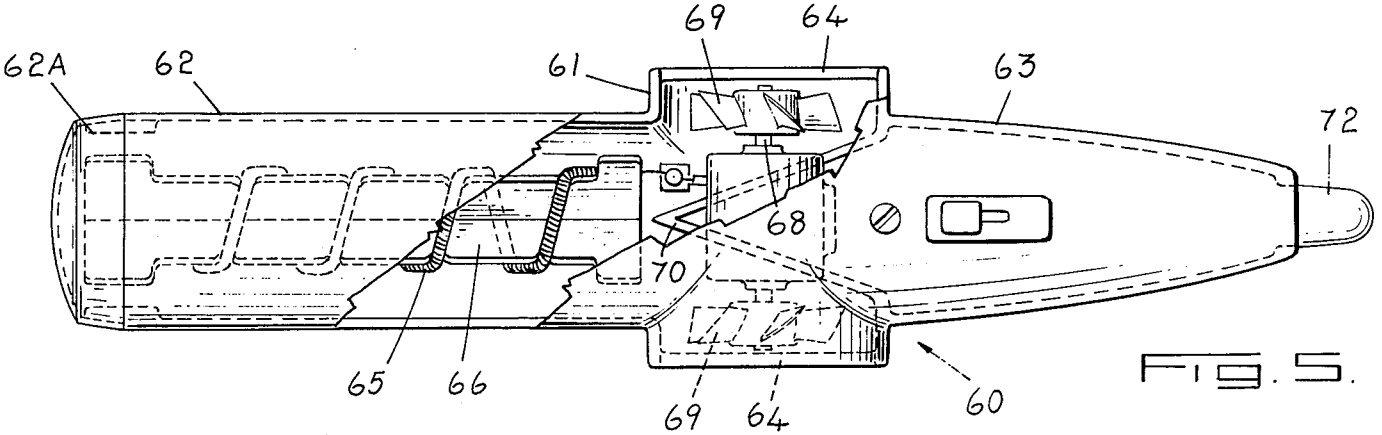
FIG. 5 is a top plan view of a hair dryer according to the second embodiment of the invention, part of the casing being broken away to show internal structure.
Figure 6:
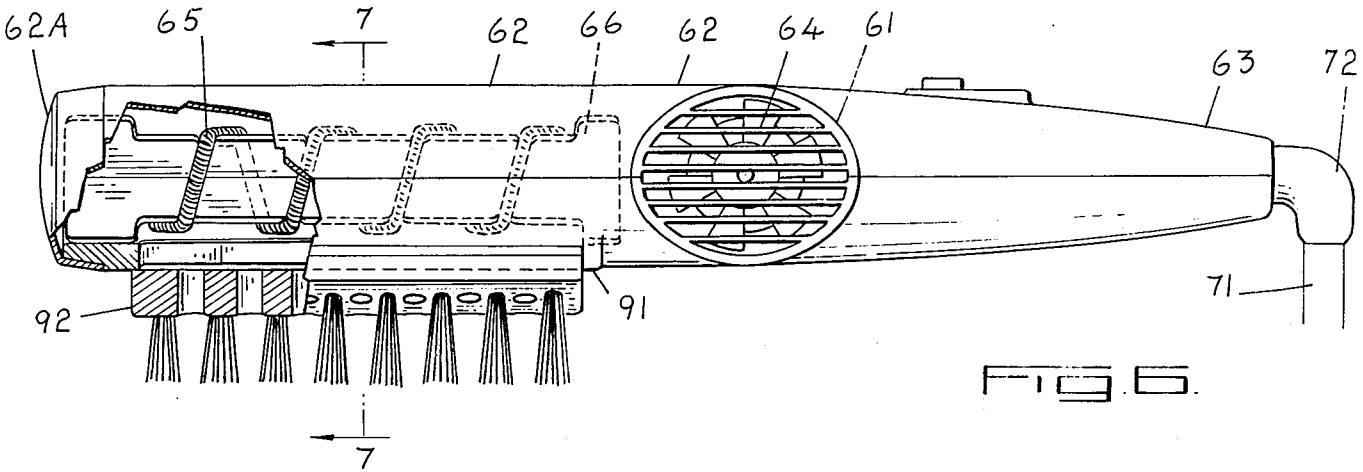
FIG. 6 is a side elevational view, partly in section, of the hair dryer shown in FIG. 5.

In FIG. 3 the hair dryer is shown in association with a brush attachment 28, the brush attachment having an elongated, perforate hollow body closed at one end 29, and having an air inlet opening at its other end 30. In this case the inlet end of the brush body is formed with integral radial wings 31, which fit inside the terminal portion 12A of the hair dryer nozzle for attaching the brush thereto.

In FIG. 4 yet another type of attachment is shown. In this case an adaptor 32 is provided for connecting hair dressing attachments such as a brush 35, to the hair dryer nozzle. The adaptor 32 is closed at one end 33, and has a socket 34 at its other end for connection to the terminal portion 12A of the hair dryer nozzle. The wall of the adaptor provides an elongated socket 36 into which an elongated spigot portion 37 of the brush can be inserted.

A hair dryer in accordance with the second embodiment of the invention is illustrated in FIGS. 5 – 8. The hair dryer has an elongated casing 60 which provides a fan housing 61, a heater housing 62, and a handle portion 63. The casing 60 is formed of two complementary half shells and is split in a medial longitudinal plane as in the first embodiment. A power cable 71 containing leads for supplying current to the fan motor and the electric resistance heating element is connected to the end of the handle portion 63 by means of a swivel connector 72. The fan housing provides a pair of laterally spaced air inlets 64 which are generally oval in shape, rather than circular as in the first embodiment, but this variation is not pertinent to the functioning of the hair dryer. The motor 67, drive shafts 68, fans 69, and deflector 70 are identical to the motor 17, drive shafts 18, fans 19 and deflector 20 of the first embodiment.

The heater housing 62 houses an electric resistance heating element 65 which is mounted on a former 66. The heater housing is open to the fan housing at one end, and is closed at its other end 62A. The air outlet of the hair dryer is constituted by an elongated, longitudinally extending slot 90, the longitudinal edges of the slot being bordered by coupling means in the form of a pair of longitudinal ribs 91, for the attachment of various hair dressing attachments, such as a brush 92 (FIGS. 6 and 7), and a comb 93 (FIG. 8).

What I claim as my invention is:

1. A hair dryer comprises an elongated casing, said casing providing a fan housing and a heater housing extending longitudinally therefrom, the fan housing providing a pair of laterally spaced air inlets and the heater housing providing an air outlet, electric heating means mounted in said heater housing, an electric motor mounted in said fan housing, a pair of fans located in the fan housing and coupled to the motor to be driven thereby, each fan cooperating with a respective one of said air inlets, deflector means located in the fan housing and positioned to deflect incoming air from each of said inlets into said heater housing, and means for supplying electric current to said electric heating means and said motor.

2. A hair dryer comprising an elongated casing, said casing providing a fan housing and a heater housing extending longitudinally therefrom, the heater housing defining a longitudinal axis, the fan housing providing a pair of laterally spaced air inlets and the heater housing providing an air outlet, an electric resistance heating element mounted in the heater housing, an electric motor mounted in the fan housing, the motor having a pair of opposed drive shafts extending transversely with respect to said longitudinal axis, a pair of fans connected to said drive shafts to be driven thereby, each fan cooperating with a respective one of said air inlets, a deflector located in the fan housing, the deflector providing a pair of wall surfaces positioned respectively to intercept incoming air from the air inlets and to deflect the air axially along the heater housing, and means for supplying electric current to said heating element and said motor.

3. A hair dryer according to claim 2, wherein the casing additionally provides an elongated handle portion extending longitudinally from the fan housing substantially in alignment with the heater housing.

4. A hair dryer according to claim 2, wherein the fan housing is of generally cylindrical shape having an axis transverse to said longitudinal axis, the air inlets being located at opposite ends of the fan housing, said motor being mounted coaxially with the fan housing.

5. A hair dryer according to claim 4, wherein the casing is formed of two complementary half shells of molded plastic material, the casing being split in a medial longitudinal plane.

6. A hair dryer according to claim 5, wherein the deflector is formed of two complementary members, each said member being of molded plastic material and integral with a respective one of said complementary half shells.

7. A hair dryer according to claim 2, in which the heater housing constitutes a tubular nozzle, the tubular nozzle having an axially extending terminal portion defining said air outlet.

8. A hair dryer according to claim 7, wherein the tubular nozzle is tapered from the fan housing to the terminal portion.

9. In combination with a hair dryer as claimed in claim 7, a hair dressing attachment, said hair dressing attachment having an integral coupling means engageable with the terminal portion of the tubular nozzle for removably connecting the hair dressing attachment to the dryer.

10. A hair dryer according to claim 2, wherein the heater housing is constituted by an elongated portion of the casing said elongated portion having an open end communicating with the fan housing and a closed end remote from the fan housing, said elongated portion of the casing further providing a longitudinally extending slot defining said air outlet.

11. In combination with a hair dryer as claimed in claim 10, said longitudinally extending slot being bounded by a pair of longitudinal ribs projecting from said elongated portion of the casing, a hair dressing attachment having an elongated body portion, said elongated body portion having integral coupling means slidably engageable with the pair of ribs for removably coupling the hair dressing attachment to the hair dryer in juxtaposition to the air outlet.

* * * * *